US005226188A

United States Patent [19]

Liou

[11] Patent Number: 5,226,188

[45] Date of Patent: Jul. 13, 1993

[54] VENTILATED FOAM CUSHION

[76] Inventor: Yaw-Tyng Liou, P.O. Box 82-144, Taipei City, Taiwan

[21] Appl. No.: 904,712

[22] Filed: Jun. 26, 1992

[51] Int. Cl.[5] ..... A47C 27/15

[52] U.S. Cl. ..... 5/653; 5/468; 297/453

[58] Field of Search ..... 5/468, 653, 481, 469, 5/448, 654; 297/453, DIG. 1

[56] References Cited

U.S. PATENT DOCUMENTS

| | | | |
|---|---|---|---|
| 3,818,522 | 6/1974 | Schuster | 5/468 |
| 4,451,083 | 5/1984 | Marchello | 297/453 |
| 5,106,161 | 4/1992 | Meiller | 5/468 |

FOREIGN PATENT DOCUMENTS

| | | | |
|---|---|---|---|
| 3017379 | 11/1981 | Fed. Rep. of Germany | 5/468 |
| 488416 | 12/1953 | Italy | 5/468 |
| 2076648 | 12/1981 | United Kingdom | 297/453 |
| 2161376 | 1/1986 | United Kingdom | 5/468 |

*Primary Examiner*—Alexander Grosz
*Attorney, Agent, or Firm*—Alfred Lei

[57] ABSTRACT

This invention relates to a cushion and in particular to one including a pad with an upper surface having a plurality of through holes, and a seat having a recess for receiving the pad and a plurality of ventilation holes, whereby when an user seats thereon, the pad and the seat will be deformed thereby causing the air therein to eject upwardly to blow off the heat evolved from the user.

1 Claim, 6 Drawing Sheets

VENTILATED FOAM CUSHION

BACKGROUND OF THE INVENTION

It has been found that the prior art cushion is simply made of foamed material and cannot cause air to move freely therethrough thereby making the user sweat even in cool days.

Therefore, it is an object of the present invention to provide an improved cushion which may obviate and mitigate the above-mentioned drawbacks.

SUMMARY OF THE INVENTION

This invention relates to an improved cushion.

It is the primary object of the present invention to provide a cushion which may dissipate the heat evolved from the user.

It is another object of the present invention to provide a cushion which is light in weight.

It is still another object of the present invention to provide a cushion which is low in cost.

It is still another object of the present invention to provide a cushion which is simple in construction.

It is a further object of the present invention to provide a cushion which is facile to manufacture.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
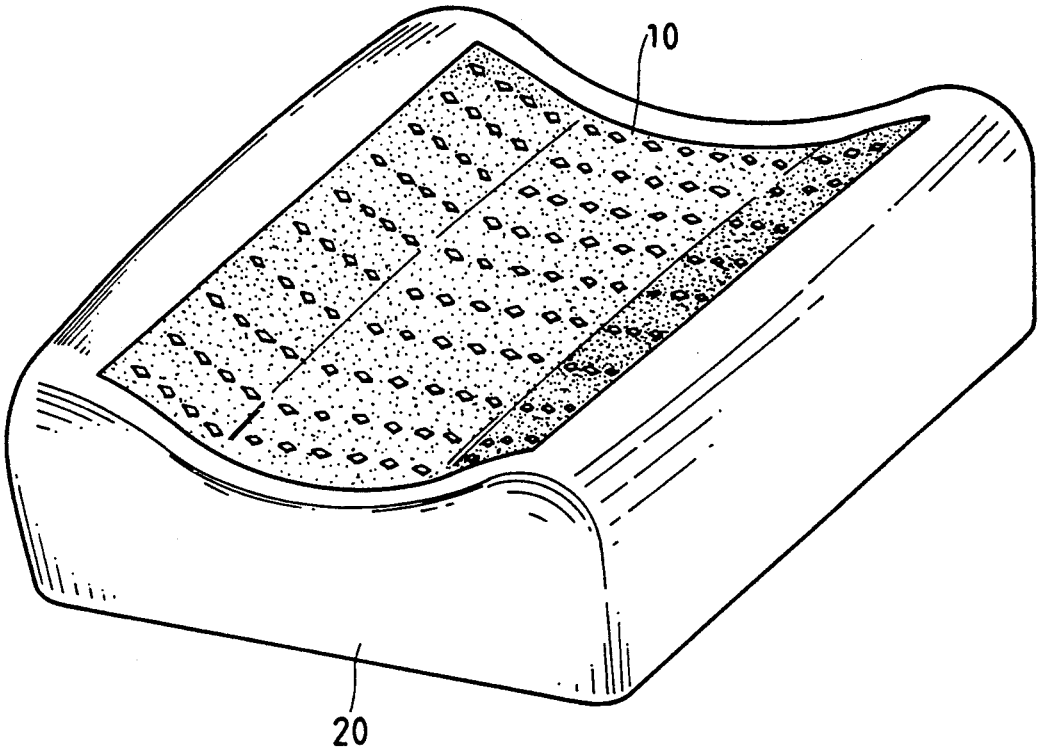
FIG. 1 is a perspective view of a cushion according to the present invention.
Figure 2:
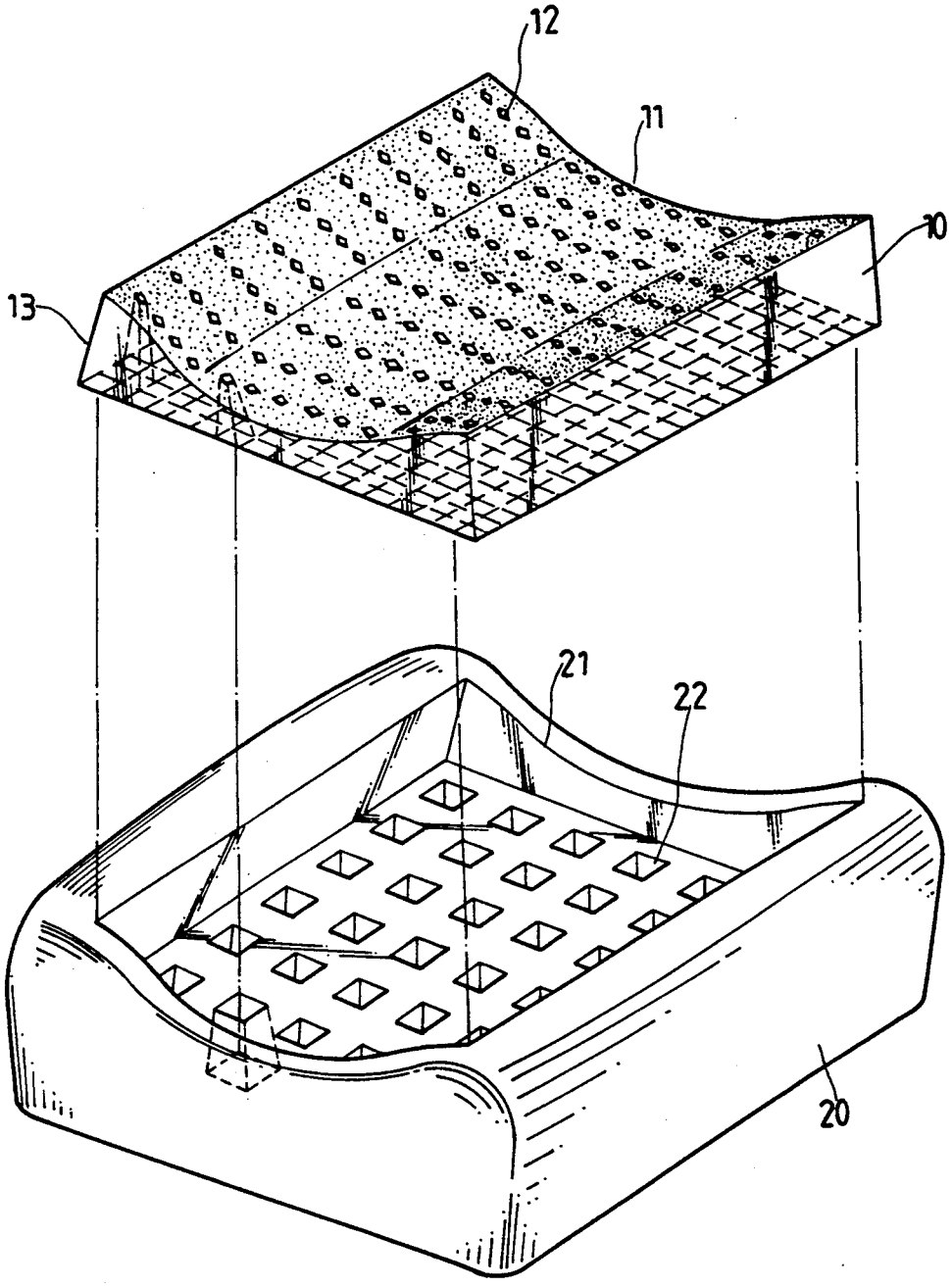
FIG. 2 is an exploded view of the cushion.
Figure 3:
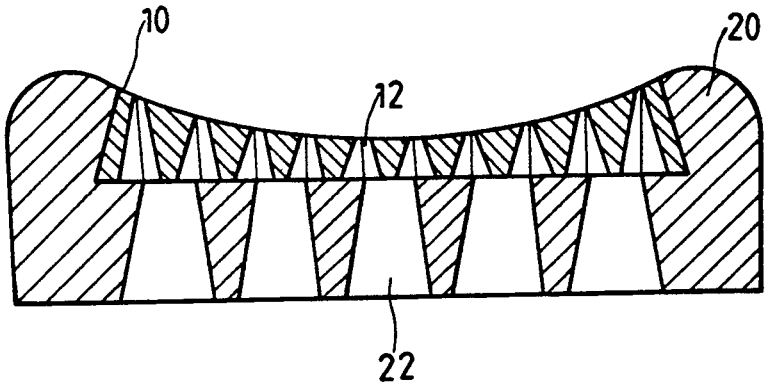
FIG. 3 is a cross-sectional view of the cushion.

With reference to the drawings and in particular to FIGS. 1, 2 and 3 thereof, the cushion according to the present invention mainly comprises a pad 10 and a seat 20 for receiving the pad 10.

The pad 10 is an integral member having an upper surface 11 on which are formed a plurality of small conical through holes 12. Further, the pad 10 is formed with two inclined sides 13 and a flat bottom.

The seat 20 is also an integral member which and has a recess 21 for receiving the pad 10. The recess 21 is provided with a plurality of conical ventilation holes 22.

Figure 5:
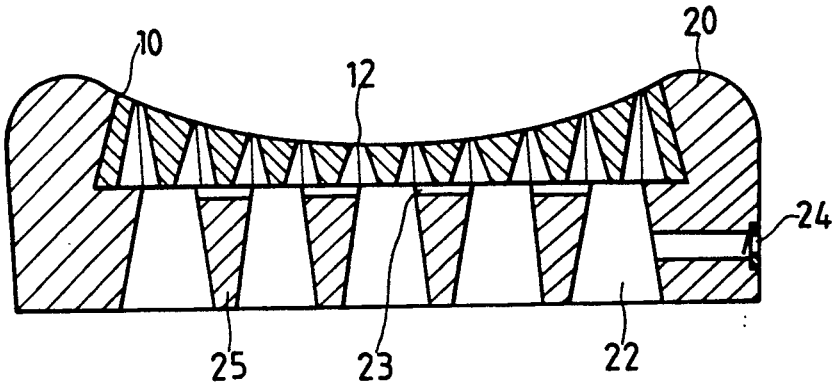
FIG. 5 is a cross-sectional view of the cushion according to the second preferred embodiment of the present invention.
Figure 4:
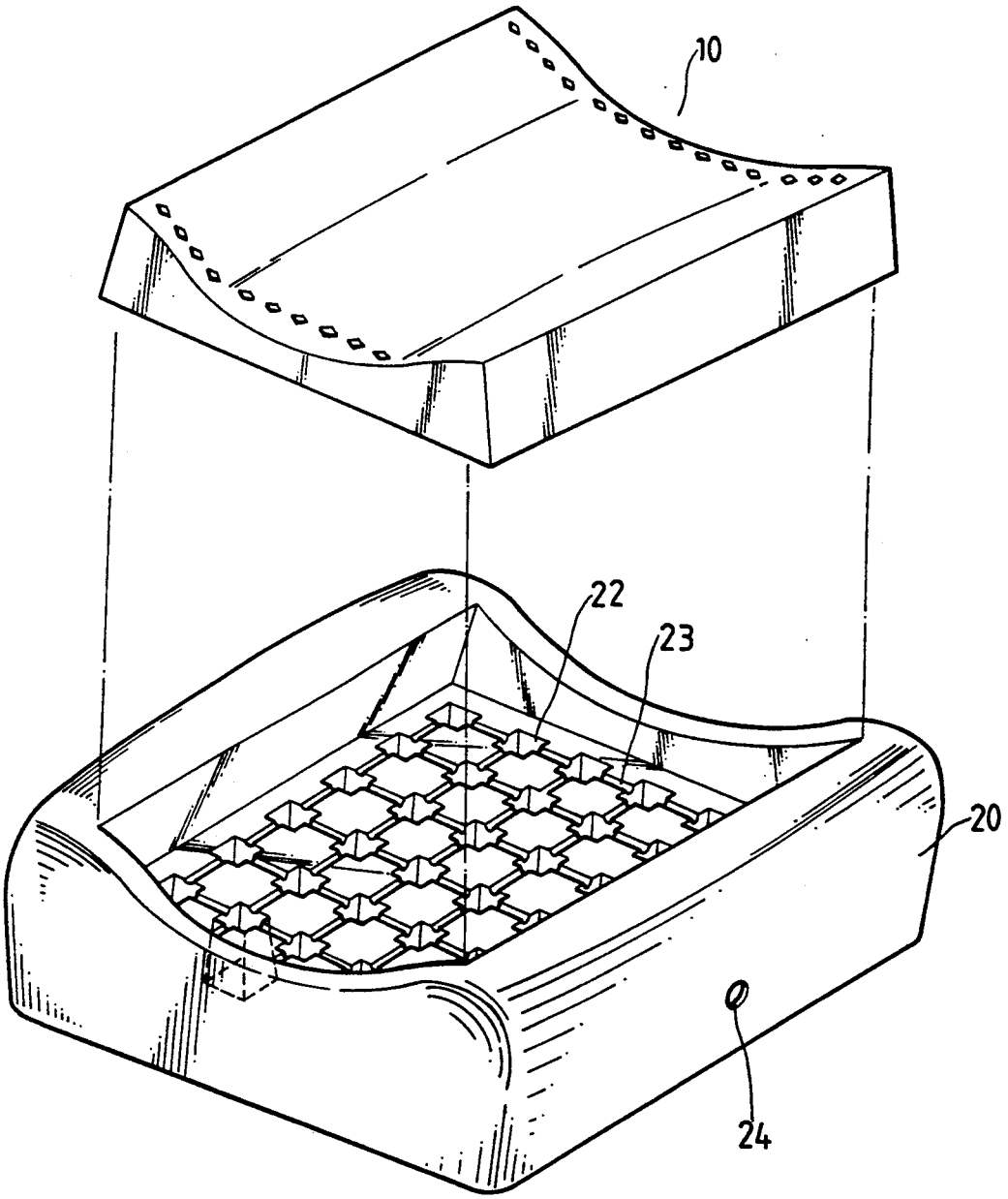
FIG. 4 is an exploded view showing a second preferred embodiment of the present invention.

FIGS. 4 and 5 show another preferred embodiment of the present invention. As illustrated, the conical ventilation holes 22 of the seat 20 are in communication with each other via passages 23 at the upper surface of the seat 20. Further, a check valve (a one-way check) 24 is provided at one side of the seat 20 and in communication with the ventilation holes 22 of the seat 20.

Figure 7:
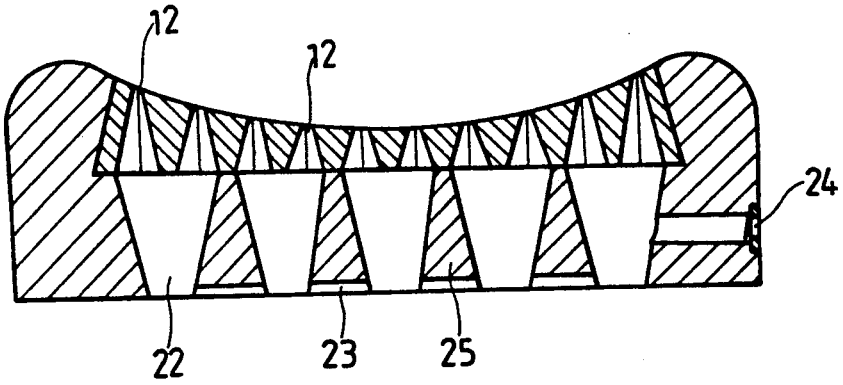
FIG. 7 is a cross-sectional view of the third embodiment of the present invention.
Figure 6:
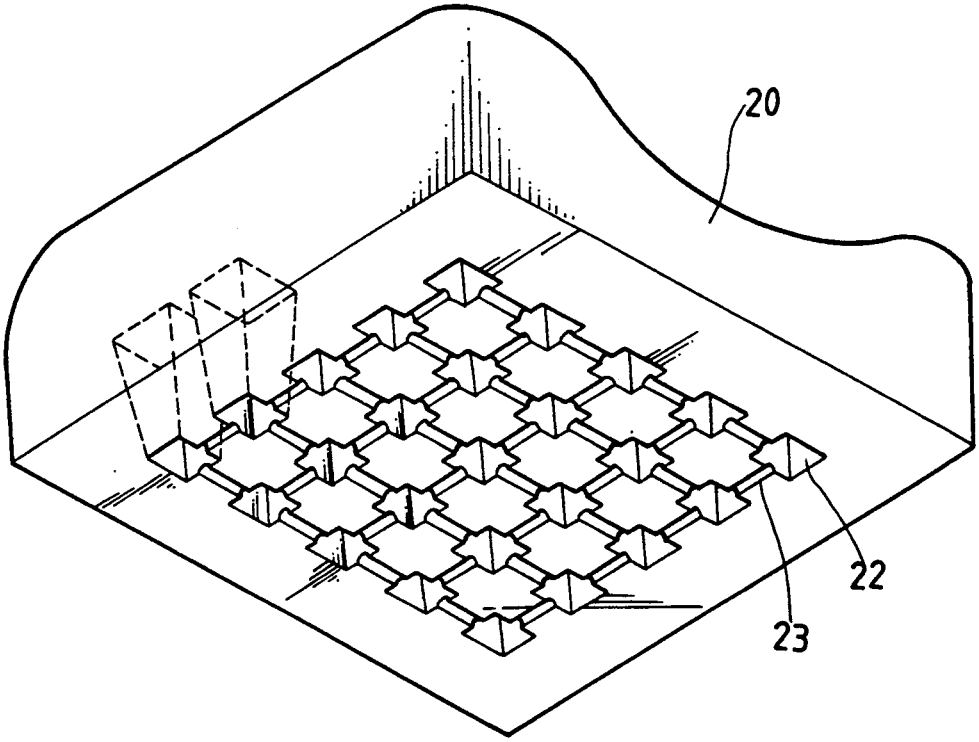
FIG. 6 shows a third preferred embodiment of the present invention.

FIGS. 6 and 7 show a third preferred embodiment of the present invention. As may be seen, the ventilation holes 22 are of an inverted conical shape and are in communication with each other via passages 23 at the bottom of the seat 20.

Figure 7A:
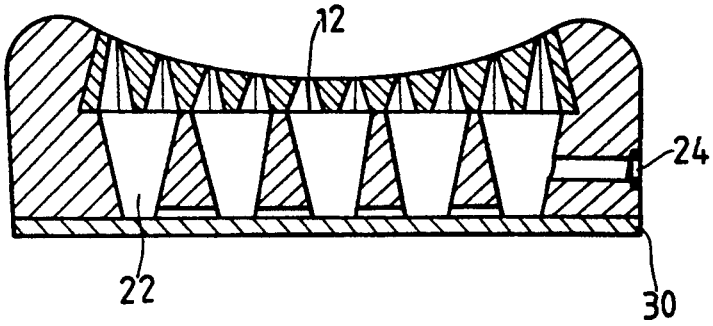
FIGS. 7A, 7B and 7C show the working principle of the present invention.
Figure 7B:
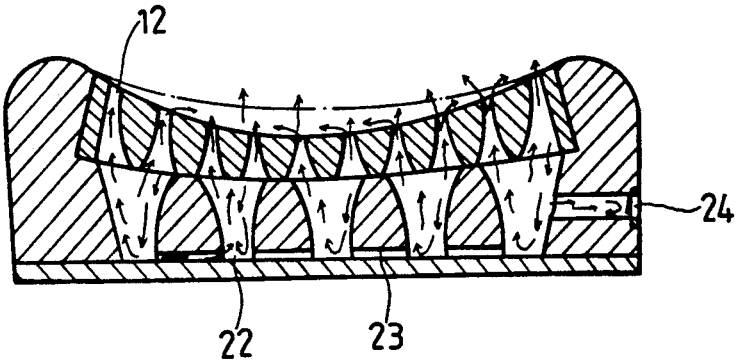
Figure 7C:
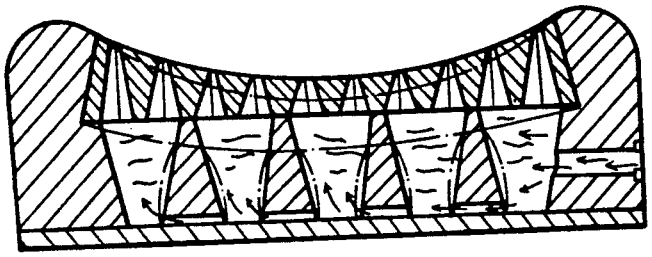

FIGS. 7A, 7B and 7C illustrate the working principle of the present invention. When an user sits on the present invention, the pad 10 and the seat 20 will be deformed thereby causing the air therein to eject upwardly to blow off the heat evolved from the user. As the pressure exerted on the present invention disappears, the pad 10 and the seat 20 will recover their shapes thus sucking in air through the check valve 24.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A cushion comprising:

a pad provided with a plurality of conical through holes and having two inclined opposite sides and a flat bottom; and a seat having a recess for receiving said pad and a check valve in communication with said recess, said recess being provided with a plurality of conical ventilation holes which are in communication with each other.

* * * * *